United States Patent [19]

Piber

[11] 4,081,641

[45] Mar. 28, 1978

[54] TOGGLE SWITCH WITH HINGED SPLIT HOUSING AND INSULATION PIERCING CONTACTS

[75] Inventor: Earl T. Piber, Oconomowoc, Wis.

[73] Assignee: Cutler-Hammer, Inc., Milwaukee, Wis.

[21] Appl. No.: 745,475

[22] Filed: Nov. 26, 1976

[51] Int. Cl.[2] ..... H01H 1/16; H01H 3/32; H01H 9/02

[52] U.S. Cl. ..... 200/153 LA; 200/277; 200/284; 200/295; 200/296; 200/303; 339/99 R

[58] Field of Search ..... 200/51 R, 67 AA, 153 G, 200/153 LA, 277, 284, 295, 296, 302, 303, 335; 339/99 R

[56] References Cited

U.S. PATENT DOCUMENTS

| | | | |
|---|---|---|---|
| 1,919,119 | 7/1933 | Nero | 200/67 AA |
| 2,329,063 | 9/1943 | Lockwood | 200/303 X |
| 2,723,327 | 11/1955 | Gilbert | 339/99 R |
| 2,802,083 | 8/1957 | Lapeyre | 339/99 R X |
| 3,327,085 | 6/1967 | Noonan | 200/284 X |
| 3,412,225 | 11/1968 | Rogers et al. | 200/303 X |
| 3,617,674 | 11/1971 | Osike | 200/284 X |
| 3,668,344 | 6/1972 | Lehmann | 339/99 R X |
| 3,882,294 | 5/1975 | Hults | 200/153 LA X |
| 3,895,198 | 7/1975 | Piber | 200/303 X |
| 3,978,298 | 8/1976 | Fukuda et al. | 200/353 X |
| 4,035,597 | 7/1971 | Josemans | 200/296 |

FOREIGN PATENT DOCUMENTS

| | | | |
|---|---|---|---|
| 1,139,929 | 7/1957 | France | 200/284 |

*Primary Examiner*—Stephen Marcus
*Attorney, Agent, or Firm*—Hugh R. Rather; William A. Autio; Michael E. Taken

[57] ABSTRACT

A toggle switch having a snap-in bushing for mounting in a hole in a panel. A one-piece foldable housing has slots for the switch parts. These parts are assembled in one housing half and the other housing half is folded over and sonically bonded to the first half. Quick-connect terminals are provided by a hinged door on one housing half that allows the terminals to be pivoted up, an insulated conductor pair inserted therebelow and the door pinched shut by pliers or the like whereby the connectors pierce the insulation to make the connections. Resilient stationary contacts and a spherical movable contact provide snap-action closing and opening of the contacts.

10 Claims, 5 Drawing Figures

TOGGLE SWITCH WITH HINGED SPLIT HOUSING AND INSULATION PIERCING CONTACTS

BACKGROUND OF THE INVENTION

Toggle switches of the snap-action type have been known heretofore. However, such prior switches, to a large extent, have been rather complex in structure requiring many parts or have been deficient in one or more functional features that are desirable in such switches. This invention relates to improvements thereover.

SUMMARY OF THE INVENTION

An object of the invention is to provide an improved toggle switch.

A more specific object of the invention is to provide a toggle switch of utmost simplicity, few parts and low manufacturing cost.

Another specific object of the invention is to provide a toggle switch of the aforementioned type with a one-piece foldable housing into which the switch parts may be assembled and then one housing half folded over and secured to the other housing half.

Another specific object of the invention is to provide a toggle switch of the aforementioned type with improved snap-action contacts wherein contact pressure increases to the trip-open point to prevent teasing of the contacts.

Another specific object of the invention is to provide a toggle switch of the aforementioned type with improved butt contacts having resiliency providing limited sliding of the contacts.

Another specific object of the invention is to provide a toggle switch of the aforementioned type with improved quick-connect terminal means requiring no insulation stripping of the wires and which completely insulates the live parts for safety in the event the circuit is live when connecting the switch to the wires.

Other objects and advantages of the invention will hereinafter appear.

DESCRIPTION OF THE PREFERRED EMBODIMENT

Figure 1:
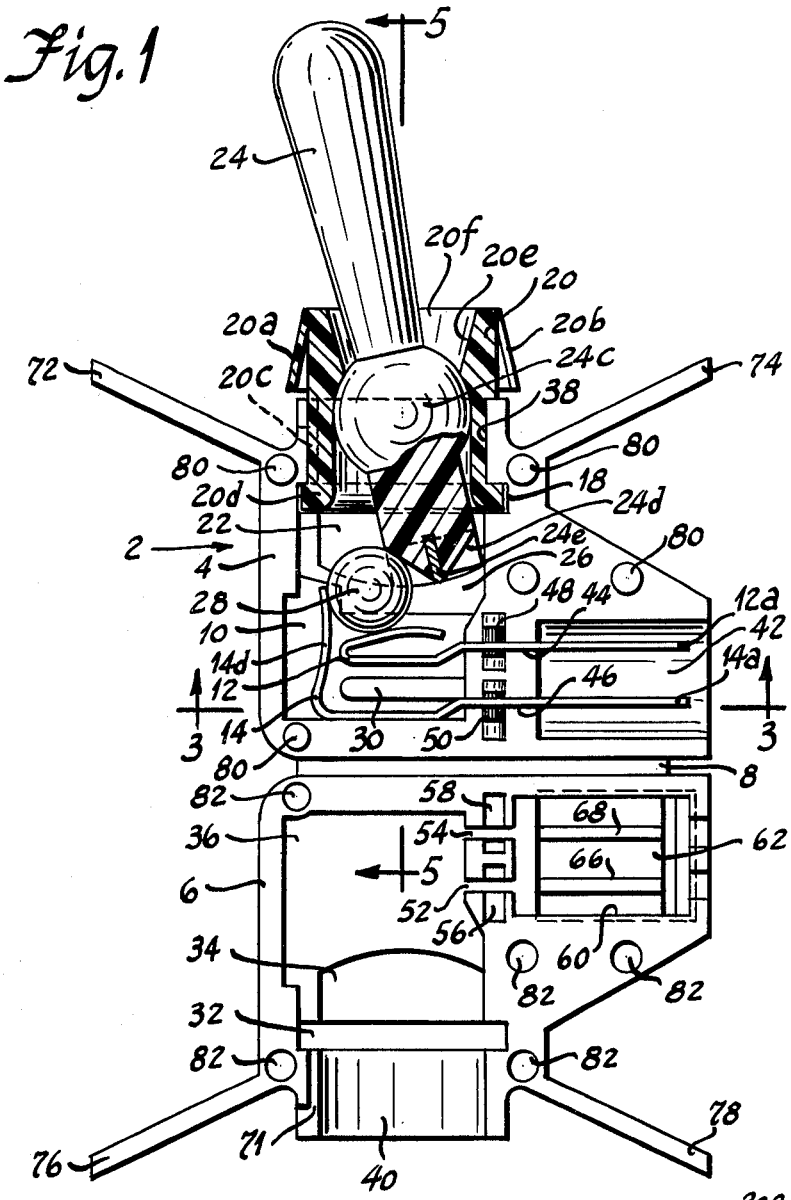
FIG. 1 is an enlarged open-housing view, partly in section, of a snap-action toggle switch showing the complementary cavities in the foldable housing halves and the switch mechanism in its contacts-closed position.

Referring to FIG. 1, there is shown a snap-action toggle switch according to the invention before the housing is folded over and closed. As shown therein, this switch is provided with a one-piece foldable housing 2 having an upper half 4 and a lower half 6 connected by an integral hinge 8. This housing is molded of plastic material such as Lexan or the like having a characteristic whereby integral thin section hinge 8 may be bent without breaking when the lower housing half is folded over the upper housing half and secured thereto to complete the switch.

Figure 3:
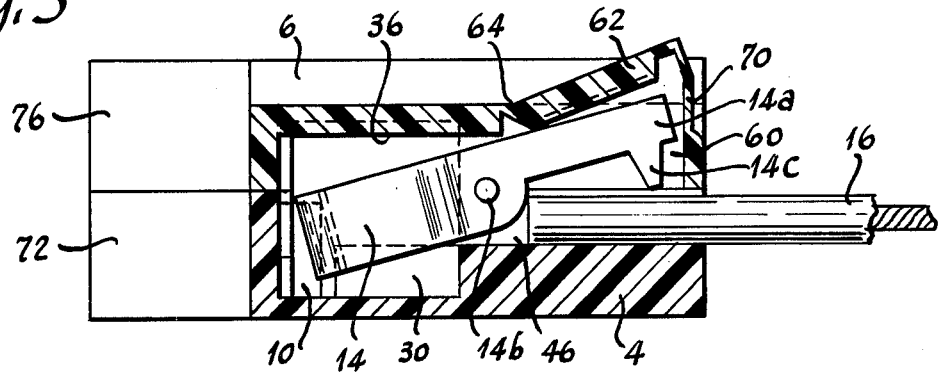
FIG. 3 is a horizontal cross-sectional view taken substantially along line 3—3 of FIG. 1 but with the lower housing half closed to show the hinged door and pivoted terminals preparatory to piercing the insulation.
Figure 5:
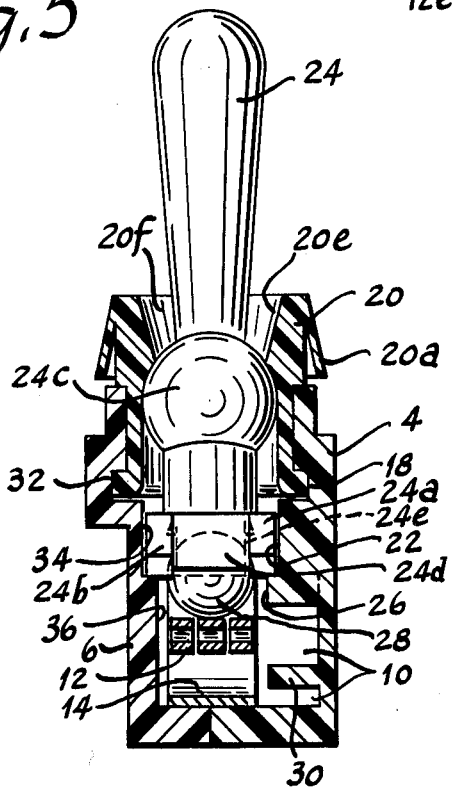
FIG. 5 is a vertical cross-sectional view taken substantially along line 5—5 of FIG. 1 but with the lower housing half closed to show the lateral shape of the toggle lever.

These two connected housing sections 4 and 6 are provided with complementary cavities affording mounting means for the switch parts. As shown in FIG. 1, upper housing half 4 has a contact cavity the deepest part 10 of which is below stationary contacts 12 and 14. This deepest part of this contact cavity provides clearance to enable the stationary contacts to be pivoted down as shown in FIG. 3 thereby raising the terminal portions 12*a* and 14*a* thereof to allow insulated conductor pair 16 to be inserted therebelow. The next deepest part of this cavity is a semi-circular groove 18 for retaining snap-in bushing 20 as shown in FIG. 5. The next deepest part 22 of this cavity provides clearance for swinging movement of the slightly projecting lateral part 24*a* of the lower portion of toggle lever 24 as shown in FIG. 5. The shallowest part of this cavity provides a retaining wall 26 to keep spherical movable contact 28 centered on the stationary contacts as shown in FIG. 5 and a strengthening wall 30 between divided sections of the deepest part 10 of this cavity as shown in FIGS. 1 and 5. While movable contact 28 is shown as spherical, it could be round or cylindrical.

The other half 6 of the housing has the remainder of the contact cavity including a deepest retaining semi-circular groove 32 for retaining snap-in bushing 20, the next deepest part 34 providing clearance for the swinging movement of the other slightly projecting lateral part 24*b* of the lower end portion of the toggle lever as shown in FIG. 5, and the shallowest part 36 providing the contact compartment.

Housing halves 4 and 6 are also provided with complementary semi-cylindrical portions 38 and 40, respectively, providing a round bore when the housing halves are brought together for embracing snap-in bushing 20.

Housing half 4 is also provided with a terminal cavity 42 into which the terminal portions 12*a* and 14*a* of stationary contacts 12 and 14 extend.

To position the stationary contacts in the housing and to pivotally support them as shown in FIGS. 1 and 3, housing half 4 is provided with a pair of spaced narrow slots 44 and 46 extending from contact cavity 10 into terminal cavity 42 and having a depth over half the width of the intermediate portions of the contacts as shown in FIGS. 1 and 3. Across the respective slots there are provided semi-cylindrical grooves for receiving pivot pins 48 and 50 that extend through holes, 12*b* in FIG. 4 and 14*b* in FIG. 3, in the stationary contacts to pivot the latter in the housing. These pivot pins 48 and 50 may be knurled at their center as shown in FIG. 1 whereby they are force-fitted into the holes in the contacts to be retained therein. The lower housing half 6 is provided with complementary, spaced narrow slots 52 and 54 and semi-cylindrical grooves 56 and 58 for retaining the other halves of the stationary contacts and their pivot pins when the housing is closed.

Housing half 6 is also provided with a terminal cavity 60 that overlies the terminal cavity in the first housing half when the two housing parts are brought together. An integrally-molded partly-open door 62 shown in FIG. 3 overlies terminal cavity 60. This door is generally rectangular in shape as shown in FIG. 1 and is provided with a thin section hinge 64 as shown in FIG. 3. This door is also provided with a pair of spaced grooves 66 and 68 shown in FIG. 1 in alignment with and for retaining the respective terminals 12*a* and 14*a* in proper piercing position when the door is closed. This door is further provided with a thin flat section 70 connecting its open edge to housing half 6 as shown in FIG. 3. When pliers are used to pinch the door shut from the position shown in FIG. 3, grooves 66 and 68 hold terminals 12*a* and 14*a* in alignment with the two stranded conductors of electric wire 16. This wire is preferably of the "zip" cord (or lamp cord) type having two stranded conductors held in spaced apart relation by rubber or plastic insulation, such insulation having a thin section between the conductors which may be readily split (or zipped) apart if it is desired to separate the conductors for stripping. However, in this application, the wire need not be split or stripped; it is merely inserted into the terminal cavity and the door is pinched shut. As a result, points 12*c* and 14*c* of the terminals (FIGS. 3 and 4) pierce the insulation and make electrical connections with the stranded conductors therewithin. At the same time, thin flat section 70 doubles up within the terminal cavity and provides sufficient interference to hold the door tightly closed and thus serves as a latch.

The toggle switch is provided with means for mounting the toggle lever in the housing and for snap-in mounting the switch in a hole in a mounting panel. This means comprises snap-in bushing 20. As shown in FIGS. 1 and 5, this bushing is generally tubular in form and has an integrally-molded snap-in skirt (or collar) 20*a* at its upper end, this skirt extending downwardly from the top of the bushing and flaring outwardly. Thus, as this skirt is pushed through the hole in the mounting panel, it will snap out again on the other side to lock the switch to the panel. This bushing is provided with a keyway 20*b* in one side of this skirt for receiving a key at the edge of the hole in the panel thereby to mount the switch non-rotatably on the panel. This bushing is also provided with an integrally molded key 20*c* along one side thereof as shown in FIG. 1 to fix it non-rotatably in keyway 71 (FIG. 1) in the housing. This bushing is also provided with a pre-formed annular flange 20*d* at its lower (or internal) end for rigidly securing the bushing in complementary semi-circular grooves 18 and 32 in the two halves of the housing. This pre-formed annular flange may be formed in a special jig after the bushing has been molded. The lower end of the bushing must be molded straight in order to get the mold out from beneath snap-in skirt 20*a*. Thereafter this molded bushing is placed in a special jig and flange 20*d* is formed thereon by ultra-sonic means or the like.

This bushing is further provided with a constriction 20*e* molded within its bore 20*f* serving as a pivotal seat for the enlarged spherical portion 24*c* of the toggle lever. The toggle lever is provided with a V-shaped lower end portion 24*d* between projecting lateral parts 24*a* and 24*b* thereof for actuating movable contact ball 28. This V-shaped lower end portion is provided with a steel tip to prevent wear. This steel tip is provided by a steel insert 24*e* fitting into a rectangular slot between projecting lateral parts 24*a* and 24*b* and having serrations on its opposite edges that bite into the ends of the slot in the toggle lever that is made of plastic material such as nylon or the like as shown in FIG. 5.

For cooperation with the aforementioned snap-in bushing, there are provided a pair of resilient, integrally-molded back-up elements 72 and 74 extending in opposite directions with upward angles from housing half 4 at the root of the collar around bore 38, 40. A similar pair of back-up elements 76 and 78 complementary to the first pair are integrally molded on the other housing half 6. Thus, when the two housing halves are folded together at hinge 8 and sonically bonded, the two pairs of back-up elements become lined up as shown in FIG. 3 to, in effect, form two double-width back-up elements. These back-up elements are bent down when the snap-in skirt is pushed through the hole in the mounting panel and press against the back of the panel to keep the flared snap-in skirt tightly against the front of the panel as more fully disclosed in my U.S. Pat. No. 3,941,965, dated Mar. 2, 1976, and assigned to the assignee of this invention. To aid in sonically bonding the two housing halves together, one housing half is provided with integrally-molded cylindrical projections 80 suitably distributed along its joining edge and the other housing half is provided with complementary recesses 82 for receiving the same to hold the housing halves in registration when they are bonded along their joining edges.

Figure 4:
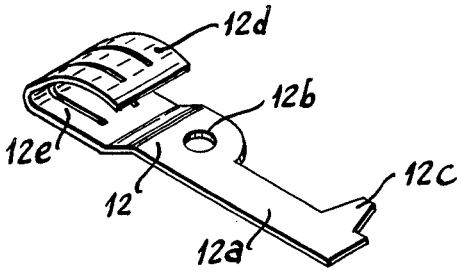
FIG. 4 is an isometric view of the upper stationary contact-terminal showing the configuration thereof.

Upper stationary contact 12 is shown more clearly in FIG. 4. To provide sufficient resiliency and closed contact pressure, the end 12*d* of this contact is bent back and bowed upwardly and is provided with a pair of spaced slits 12*e* across and beyond the bend to afford both longitudinal and lateral resiliency as the movable contact ball rolls and slides therealong. This configuration of contact 12 also allows sufficient downward deflection to enable the movable contact ball to dip below the lower end of the toggle lever as the switch is opened and closed.

Lower stationary contact 14 is shown most clearly in FIGS. 1 and 3. This contact is provided with a substantially right-angle bend to provide an upstanding contact portion 14*d* slightly bowed to the right where it extends up past the end of stationary contact 12 and in spaced relation thereto but close enough to be bridged by movable contact ball 28.

Figure 2:
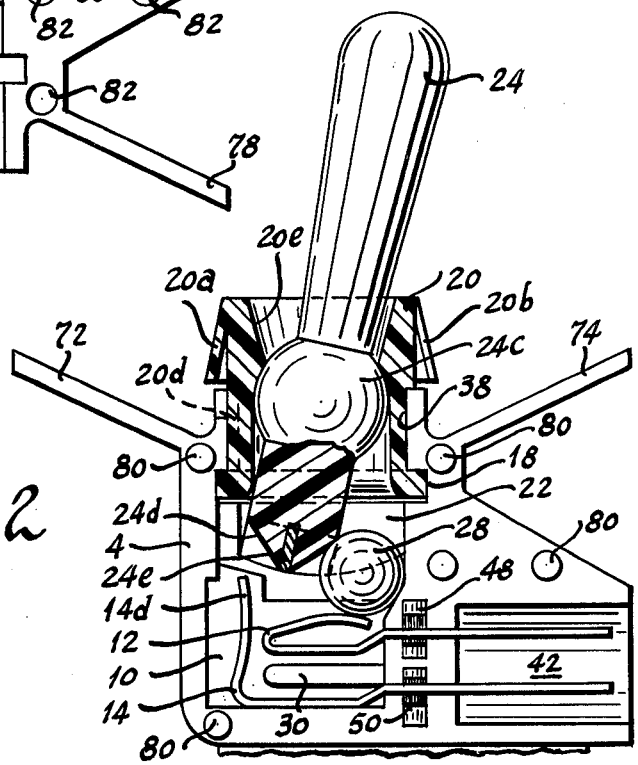
FIG. 2 is a view like FIG. 1 of one of the housing halves showing the switch mechanism in its contacts-open position.

The switch is shown in its contacts open position in FIG. 2. To close the switch, the external handle of the toggle lever is grasped and pivoted counterclockwise. This causes the right incline of the V-shaped lower end portion of the toggle lever to slide on and roll and depress movable contact ball 28 while flexing stationary contact 12 downward until the steel-tipped apex of the toggle lever passes over-center on the ball. At this point, the upward bias applied by contact 12 to the movable contact ball causes the latter to be accelerated along the left incline of the toggle lever until it stops against upward projection 14*d* of stationary contact 14. As the ball accelerates along the left incline of the toggle lever, the aforesaid upward bias also causes the toggle lever to be pivoted all the way counterclockwise until lateral projections 24*a* and 24*b* abut the right-hand wall of the contact cavity in the housing. In this position, the movable contact ball bridges the stationary contacts as shown in FIG. 1 while contact 12 provides adequate contact pressure.

To open the switch, the action is similar to the closing action hereinbefore described. Movement of the toggle lever clockwise causes the left incline of the lower end of the toggle lever to slide on and roll and depress ball 28 until the apex of the toggle lever passes over-center on the ball. Thereupon, the ball is suddenly accelerated by contact 12 to its open position and the toggle lever is pivoted all the way clockwise until its lateral projections 24*a* and 24*b* abut the left inner wall of the contact cavity as shown in FIG. 2.

The aforementioned action prevents teasing of the contacts. Thus, as the toggle lever is first moved clockwise depressing ball 28 against the resilient force of stationary contact 12, the contact pressure increases to the tripping point. This tripping point is where the apex of the toggle lever passes over-center on the ball. At this point, the ball is suddenly accelerated toward open-contact position. Since the contact pressure increases as aforesaid, there is no lessening of the contact pressure prior to tripping and thus no teasing of the contacts thereby reducing heating and burning of the contacts.

From the foregoing, it will be apparent that the movable contact ball makes butt contact with stationary contact 14 but also slides thereon sufficiently to keep the contacts clean. The movable contact ball makes rolling contact with stationary contact 12 but also slides thereon sufficiently to keep the contacts clean.

While the apparatus hereinbefore described is effectively adapted to fulfill the objects stated, it is to be understood that the invention is not intended to be confined to the particular preferred embodiment of snap-action toggle switch disclosed, inasmuch as it is susceptible of various modifications without departing from the scope of the appended claims.

I claim:

1. A snap-action toggle switch comprising:

a one-piece insulating housing having two complementary housing halves connected by a thin section hinge enabling said housing halves to be folded together and secured to one another, and a switch cavity and a terminal cavity within said housing, and slots between said switch cavity and said terminal cavity;

stationary contact means in said switch cavity and having terminal portions extending through said slots into said terminal cavity;

a round movable contact in said switch cavity for bridging said stationary contacts;

a snap-in bushing clamped between said housing halves and having external snap-in means for mounting the switch in a hole in a mounting panel;

a toggle lever mounted in said snap-in bushing and having a V-shaped inner end portion for actuating said round movable contact between closed and open positions with respect to said stationary contact means;

insulation piercing means on said terminal portions;

and means in said housing affording limited pivoting of said stationary contact means thereby to raise said terminal portions thereof to enable insertion of insulated conductor means therebelow, and pressing of said terminal portions back into their normal position causes said insulation piercing means to make electrical connection to the conductor means.

2. The snap-action toggle switch claimed in claim 1, wherein:

said housing around said terminal cavity completely surrounds said terminal portions except for an opening admitting the insulated conductor means whereby all live parts are completely insulated for safety.

3. The snap-action toggle switch claimed in claim 1, wherein:

said stationary contact means comprises a pair of elongated flat contacts, one of which is resilient to enable flexure thereof to allow said round movable contact to dip down below the apex of said V-shaped inner end portion as said toggle lever is actuated.

4. The snap-action toggle switch claimed in claim 3, wherein:

said one resilient contact is provided with a slotted bent-back contacting portion affording the required contact pressure in the contacts-closed position.

5. The snap-action toggle switch claimed in claim 4, wherein:

the other elongated flat contact is provided with a bend extending perpendicular to the end portion of said one resilient contact in spaced relation thereto for bridging by said round movable contact.

6. The snap-action toggle switch claimed in claim 5, wherein:

said round movable contact is a spherical contact.

7. The snap-action toggle switch claimed in claim 1, wherein:

said snap-in bushing comprises a preformed annular flange on its internal end and said housing halves comprise semi-circular grooves for retaining said flange when said housing halves are secured together.

8. The snap-action toggle switch claimed in claim 1, wherein:

said means in said housing affording limited pivoting of said stationary contact means comprises:

an integrally molded, partly-open door in one of said housing halves overlying said terminal cavity and said terminal portions therein and including means latching the same when it is pinched shut to force said terminal portions into insulation piercing position.

9. The snap-action toggle switch claimed in claim 1, wherein:

said stationary contact means comprises a pair of contacts having elongated flat terminal portions;

said insulation piercing means comprises sharp projections formed on said terminal portions;

and said limited pivoting means in said housing comprises pivot pins seated in grooves in said housing for the respective stationary contacts;

and a partly-open door integral with one housing half overlying said terminal cavity providing clearance for pivoting said terminal portions up to insert insulated conductors therebelow whereby pinching said door shut causes piercing of the insulation by said sharp projections to connect said stationary contacts to a pair of conductors.

10. The snap-action toggle switch claimed in claim 9, wherein:

said housing and said snap-in bushing and said toggle lever completely insulate all the live parts of the switch for safety.

* * * * *